US006786459B2

(12) United States Patent
Pilesi

(10) Patent No.: US 6,786,459 B2
(45) Date of Patent: Sep. 7, 2004

(54) CONCRETE RAILROAD TIE TURNOUT ASSEMBLY

(75) Inventor: William D. Pilesi, Monroeville, PA (US)

(73) Assignee: KSA Limited Partnership, Pittsburgh, PA (US)

( * ) Notice: Subject to any disclaimer, the term of this patent is extended or adjusted under 35 U.S.C. 154(b) by 0 days.

(21) Appl. No.: 10/287,366

(22) Filed: Nov. 4, 2002

(65) Prior Publication Data

US 2004/0084547 A1 May 6, 2004

(51) Int. Cl.[7] ..... B61L 5/00
(52) U.S. Cl. ..... 246/415 R; 246/468; 238/264
(58) Field of Search ..... 238/264, 265, 238/27, 29, 2, 5, 7, 68, 266, 269, 270, 287, 306, 310, 283, 298, 304, 382, 321; 246/415 R, 435 R, 452, 453, 454, 458, 463, 467, 468

(56) References Cited

U.S. PATENT DOCUMENTS

| | | | | | |
|---|---|---|---|---|---|
| 752,753 | A | * | 2/1904 | Bowman | 238/93 |
| 1,045,741 | A | * | 11/1912 | Pinney | 238/86 |
| 1,071,361 | A | * | 8/1913 | Sisk | 238/91 |
| 1,147,321 | A | * | 7/1915 | Hammons et al. | 238/265 |
| 1,362,561 | A | * | 12/1920 | Cook | 238/91 |
| 1,814,239 | A | * | 7/1931 | Buckbee | 238/30 |
| 3,863,329 | A | * | 2/1975 | Bartlett | 29/428 |
| 3,945,566 | A | | 3/1976 | Bush | |
| 4,005,839 | A | | 2/1977 | Frank | |
| 4,050,839 | A | * | 9/1977 | Frank | 246/415 R |
| 4,065,006 | A | | 12/1977 | Barry | |
| 4,119,271 | A | | 10/1978 | Campbell | |
| 4,349,150 | A | * | 9/1982 | Lubbers | 238/265 |
| 4,925,094 | A | | 5/1990 | Buekett | |
| 5,020,441 | A | | 6/1991 | Burg | |
| 5,110,046 | A | | 5/1992 | Young | |
| 5,330,136 | A | | 7/1994 | Colbaugh | |
| 5,464,153 | A | * | 11/1995 | Broughton | 238/117 |
| 5,494,212 | A | * | 2/1996 | Owen | 238/265 |
| 5,496,004 | A | | 3/1996 | Kuhn | |
| 5,918,806 | A | | 7/1999 | Keightley et al. | |
| 6,257,494 | B1 | | 7/2001 | Tokuoka et al. | |
| 6,336,265 | B1 | | 1/2002 | Niedermair | |
| 6,343,748 | B1 | | 2/2002 | Pilesi et al. | |
| 2002/0070283 | A1 | | 6/2002 | Young | |

* cited by examiner

*Primary Examiner*—Frantz F. Jules
(74) *Attorney, Agent, or Firm*—Reed Smith LLP

(57) ABSTRACT

Concrete railroad ties are made having steel plates cast directly into the concrete railroad tie so that the top surface of each steel plate is even with the top surface of the concrete railroad tie. Fasteners for the rails can be welded to anywhere within the steel plate. Additionally, each steel plate can be cast into one of two different positions of the concrete railroad tie thus, creating more flexibility as to the positions of the rail fasteners on the railroad tie and reducing the length of the steel plate needed by half to three inches. By utilizing this assembly, the amount of concrete the patterns needed in a turnout is reduced.

6 Claims, 10 Drawing Sheets

CONCRETE RAILROAD TIE TURNOUT ASSEMBLY

FIELD OF THE INVENTION

This invention relates to a railroad turnout and specifically to an improved railroad turnout utilizing concrete railroad ties.

BACKGROUND OF THE INVENTION

Typically, a turnout 10 (FIG. 1) is a device used in railroading to direct a train moving on an entry track 12 to one of multiple discharge tracks 14. The entry track 12 includes two spaced apart rails 16, which are continuous with outer rails of the discharge tracks. The inner rails 18 of the discharge tracks 14 intersect and are joined by a device known as a frog 20. As in a typical railroad track, railroad ties 22 used in a turnout are spaced at predetermined intervals below the rails 16. Historically, hardwood railroad ties have been used, but concrete railroad ties have been used in modern railroads for many years. Concrete railroad ties are very heavy, weighing as much as three times that of a hardwood railroad tie.

The turnout comprises a switch section, a closure section, a frog guardrail section and a heel section. In each of the sections, the rails are mounted on varying lengths of railroad ties. The length of the railroad tie varies with respect to its position in each section. Typically, it is desirable to maintain a constant length overhang of railroad tie between the outer rails and the end of the railroad tie. In the utilization of concrete railroad ties, it is sometimes necessary to have a separate railroad tie pattern for each railroad tie needed. This is both time consuming and costly. A conventional concrete railroad tie turnout assembly 24 is shown in FIG. 2*a*. At each rail seat area 26 where a rail 28 is to be fastened to a concrete railroad tie 30, either cast in shoulder inserts 31, 32 are provided opposing each other on field and gauge sides of the rail seat area 26, respectively or bolted steel plates 34 with attached fastenings. The cast in shoulder inserts 31, 32 (FIGS. 2*b*, 3*a* and 4) are permanently mounted within the concrete railroad tie 30 at a position directly adjacent to the rail 28. An insulator spacer 36 is placed adjacent to and abutting the base or toe 38 of the rail 28 between the rail 28 and the shoulder insert 31, 32 with an elastomeric pad 40 beneath the rail 28. A retaining clip 42 is attached to a shoulder insert 31, 32 by way of inserting through a longitudinal receiving hole 44 in a shoulder insert 31, 32, pressing upon the outer surface of the corresponding insulator spacer 36 to rigidly secure rail 28 to the concrete railroad tie 30. This arrangement is the most cost effective from a raw material standpoint, but requires a separate unique pattern for each concrete railroad tie. An advantage therefore exists for a turnout assembly requiring a reduced number of concrete railroad tie patterns and the fewest bolted plate rail seats.

A concrete railroad tie turnout assembly 46 (FIGS. 5–8) developed in 1989 by KOPPERS INDUSTRIES INC. (a partner in KSA, the assignee of the present invention) addressed some of the problems associated with concrete railroad tie turnouts by reducing the number of concrete railroad tie patterns needed. In this assembly, concrete railroad ties 48 were laid in groups 50 having the same lengths (FIGS. 5 and 6.) Each group includes railroad ties 48 having the same length while the next downstream group includes railroad ties 48 which are six inches longer than the preceding group. Typically, each group in the example consists of one to four railroad ties 48. The concrete railroad ties 48 utilized in these turnouts 46 have cast steel inserts in the form of bolt receptacles 50. Oversize eight-inch steel plates 52 are bolted to the bolt receptacles so that the steel plates 52 rest on top of rubber pads 54 that lie between the plates 52 and the upper surface of the concrete railroad ties 48. A railroad tie shoulder 56, 57 is welded to each steel plate 52 at a predetermined location on the steel plate 52 (FIGS. 7 and 8). By utilizing this assembly (bolted-on plate turnout), the amount of concrete tie patterns needed in a standard #7 turnout is reduced from forty to sixteen. A further advantage therefore exists for a turnout assembly requiring a reduced number of concrete railroad tie patterns while also making the ties of each length interchangeable with railroad ties of the same length in any number turnout of either left or right hand. All unique fittings or fastenings are entirely on the bolted plates. This arrangement also has advantages in reducing the required number of maintenance spare railroad ties.

SUMMARY OF THE INVENTION

In accordance with one embodiment of the present invention, a turnout assembly is assembled having concrete railroad ties to which rails are attached using fasteners. The type of fasteners used depends on the position of the fastener within the turnout assembly. The fastener used is selected from a group including conventional cast shoulders, bolted steel plates and steel plates cast directly into the concrete railroad tie so that the top surface of each cast steel plate is substantially flush with the top surface of the concrete railroad tie. Fasteners for the rails are welded to predetermined positions on the steel plates. Additionally, each cast in steel plate can be cast into one or more positions on the concrete railroad tie thus, creating more flexibility as to the positions of the rail fasteners on the railroad tie and reducing the length of the cast in steel plate needed. The cast in steel plate rail seats with weld on shoulders are more costly than rail seats with cast in shoulders, but significantly less costly than bolted steel plates.

Other features of the invention will be apparent from the following description, the accompanying drawings and appended claims.

DETAILED DESCRIPTION OF THE PREFERRED EMBODIMENTS

Figure 1:
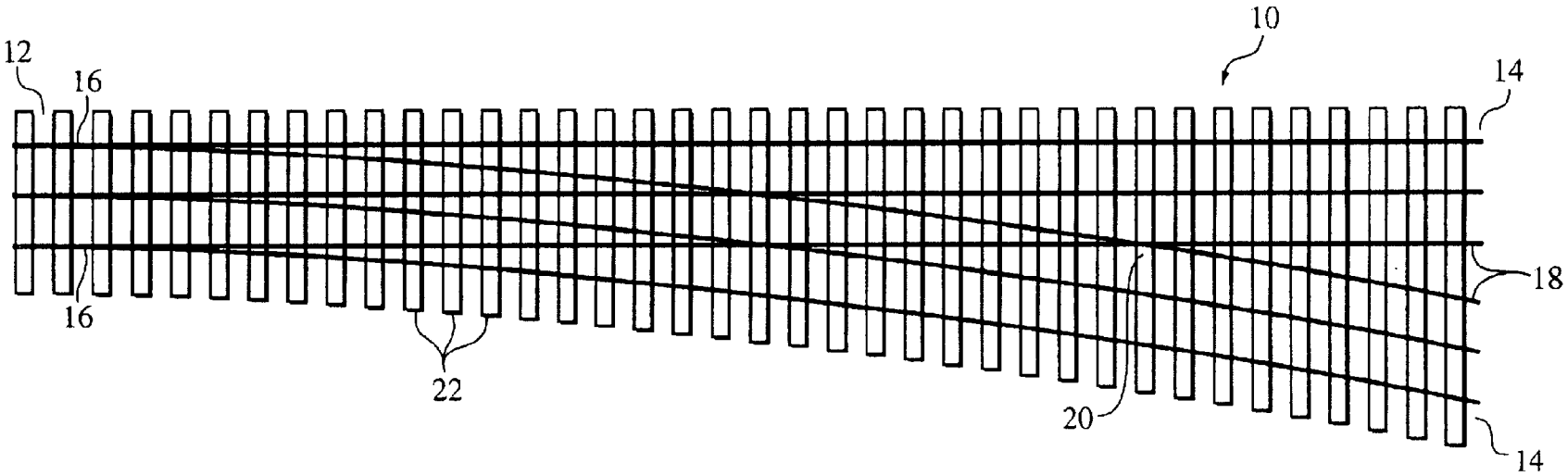
FIG. 1 PRIOR ART
FIG. 1 is plan view of a conventional concrete railroad tie turnout according to the prior art.
Figure 2A:
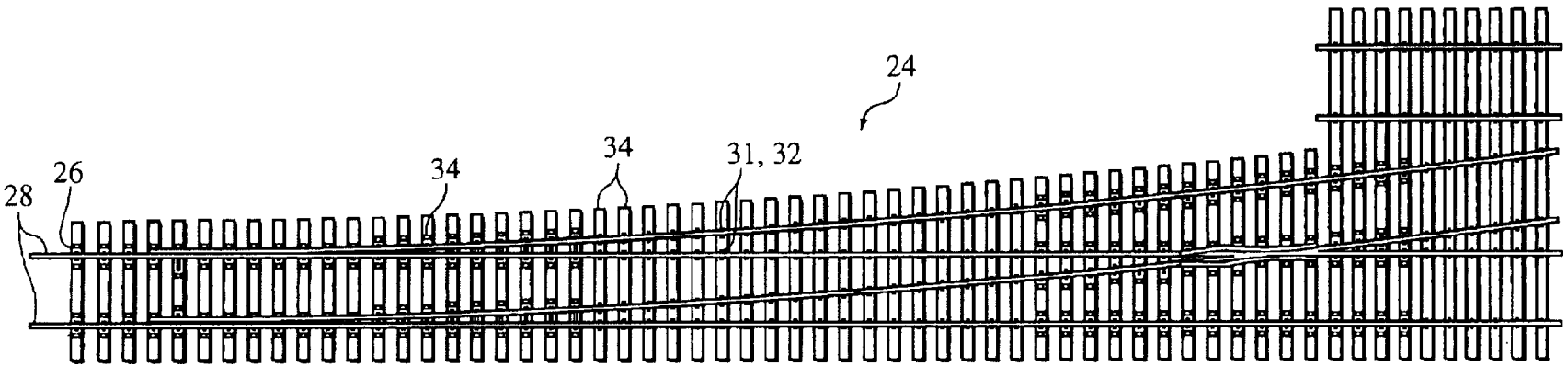
FIG. 2a PRIOR ART
FIG. 2*a* is plan view of another conventional concrete railroad tie turnout according to the prior art.
Figure 2B:
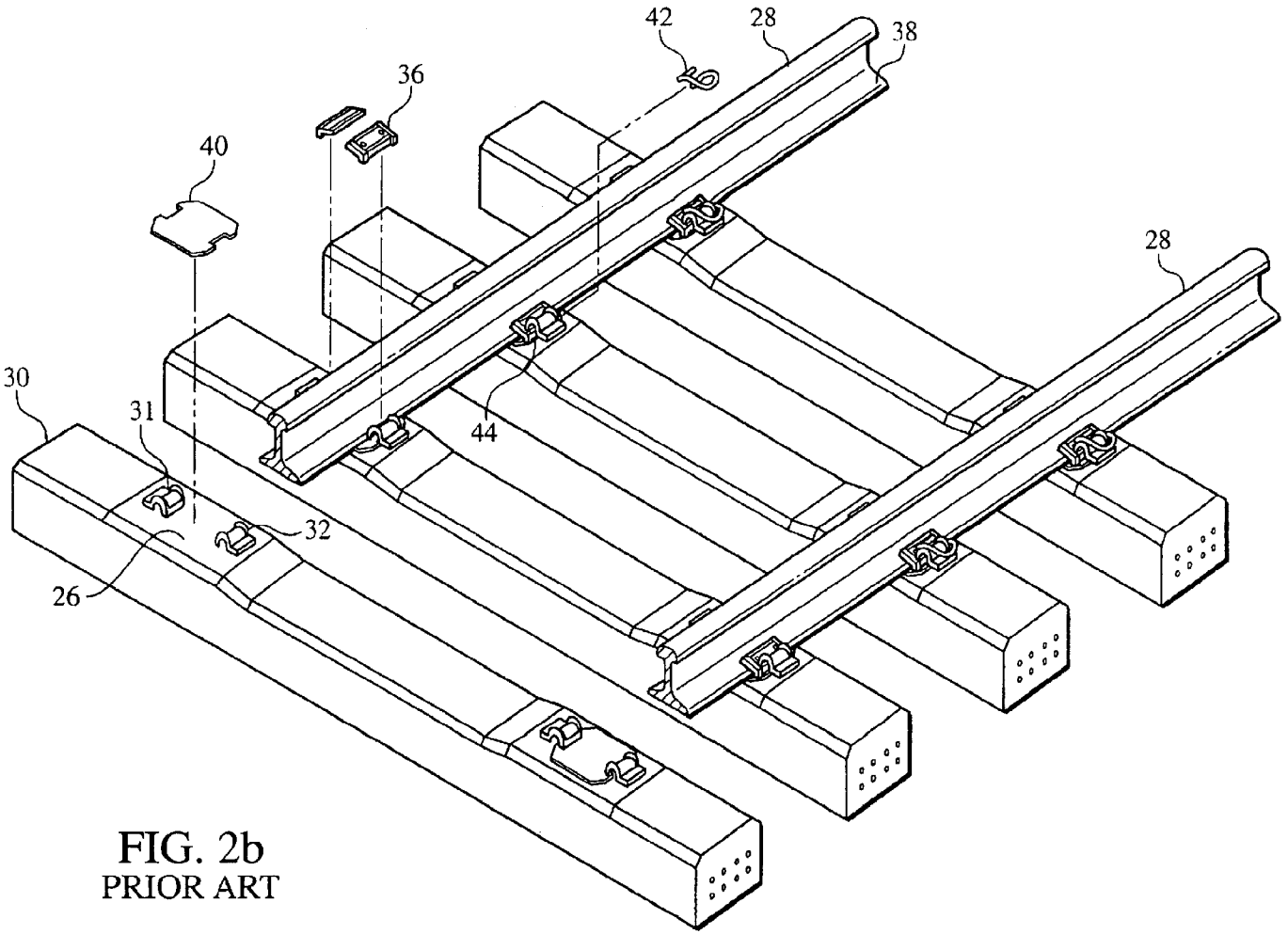
FIG. 2b PRIOR ART
FIG. 2*b* is a partially exploded perspective view of a concrete railroad tie fastening assembly utilizing cast in shoulders according to the prior art.
Figure 3:
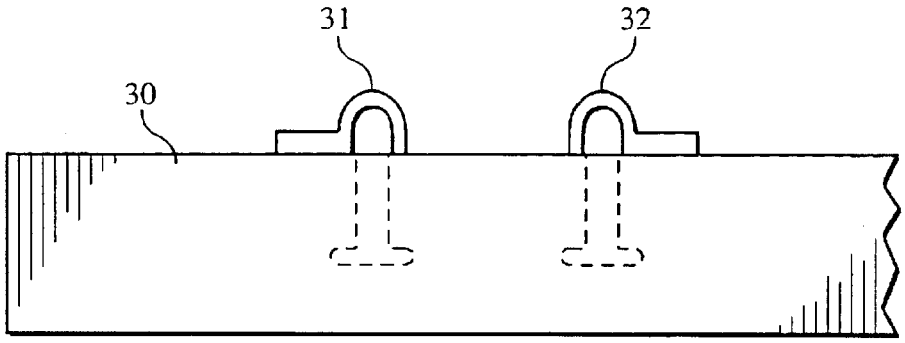
FIG. 3 PRIOR ART
FIG. 3 is a partial side view of a concrete railroad tie of FIG. 2.
Figure 4:
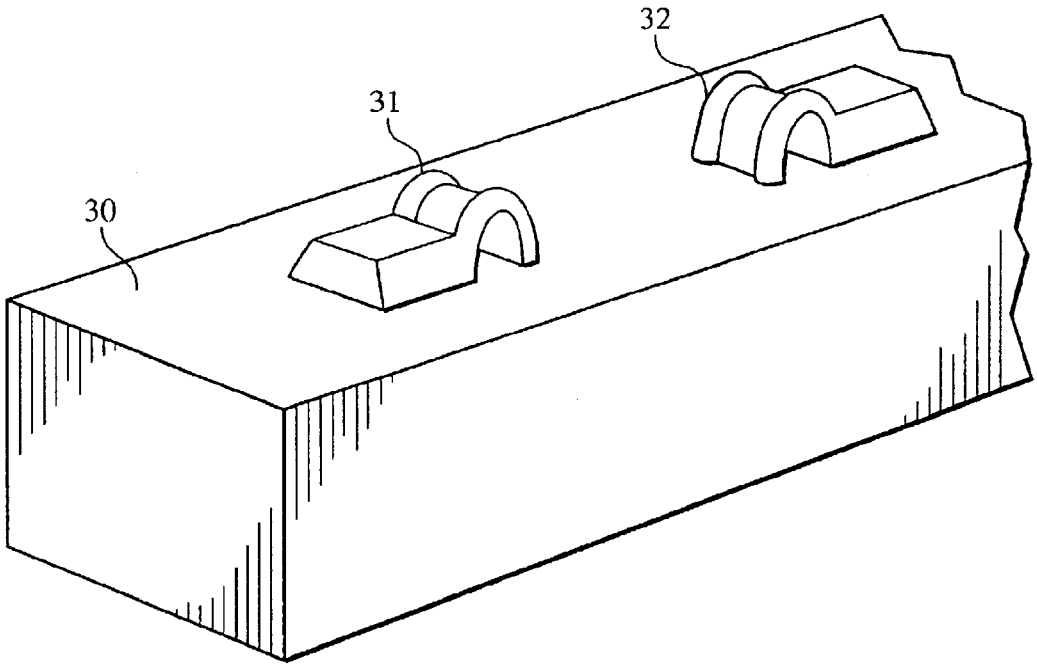
FIG. 4 PRIOR ART
FIG. 4 is a partial perspective view of a concrete railroad tie of FIG. 2.
Figure 7:
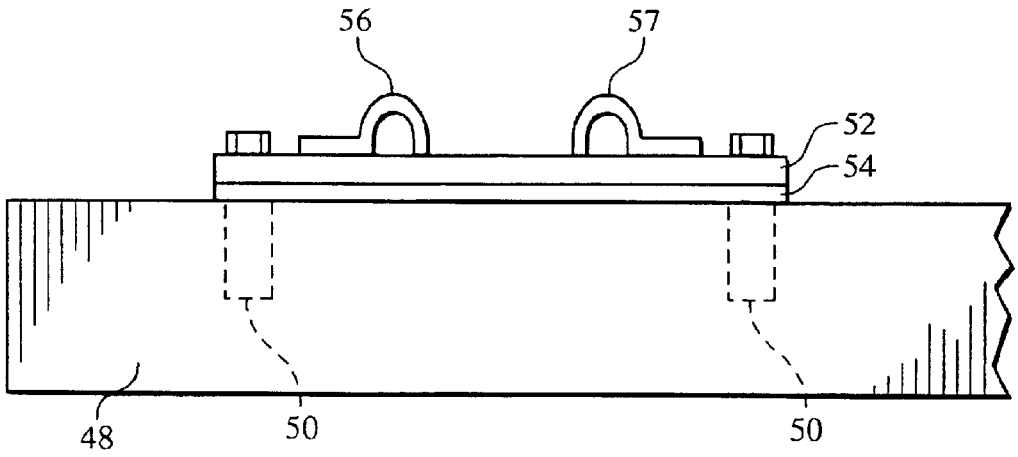
FIG. 7 PRIOR ART
FIG. 7 is a partial side view of a concrete railroad tie having a cast steel bolt receptacle according to the prior art of FIG. 6.
Figure 8:
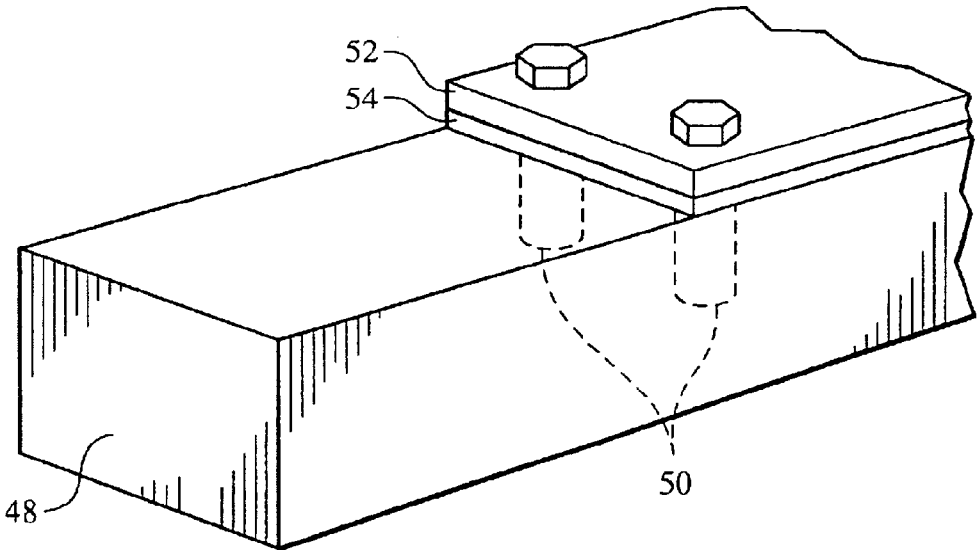
FIG. 8 PRIOR ART
FIG. 8 is a partial perspective view of the concrete railroad tie of FIG. 6 having a steel plate bolted to the bolt receptacle.
Figure 9:
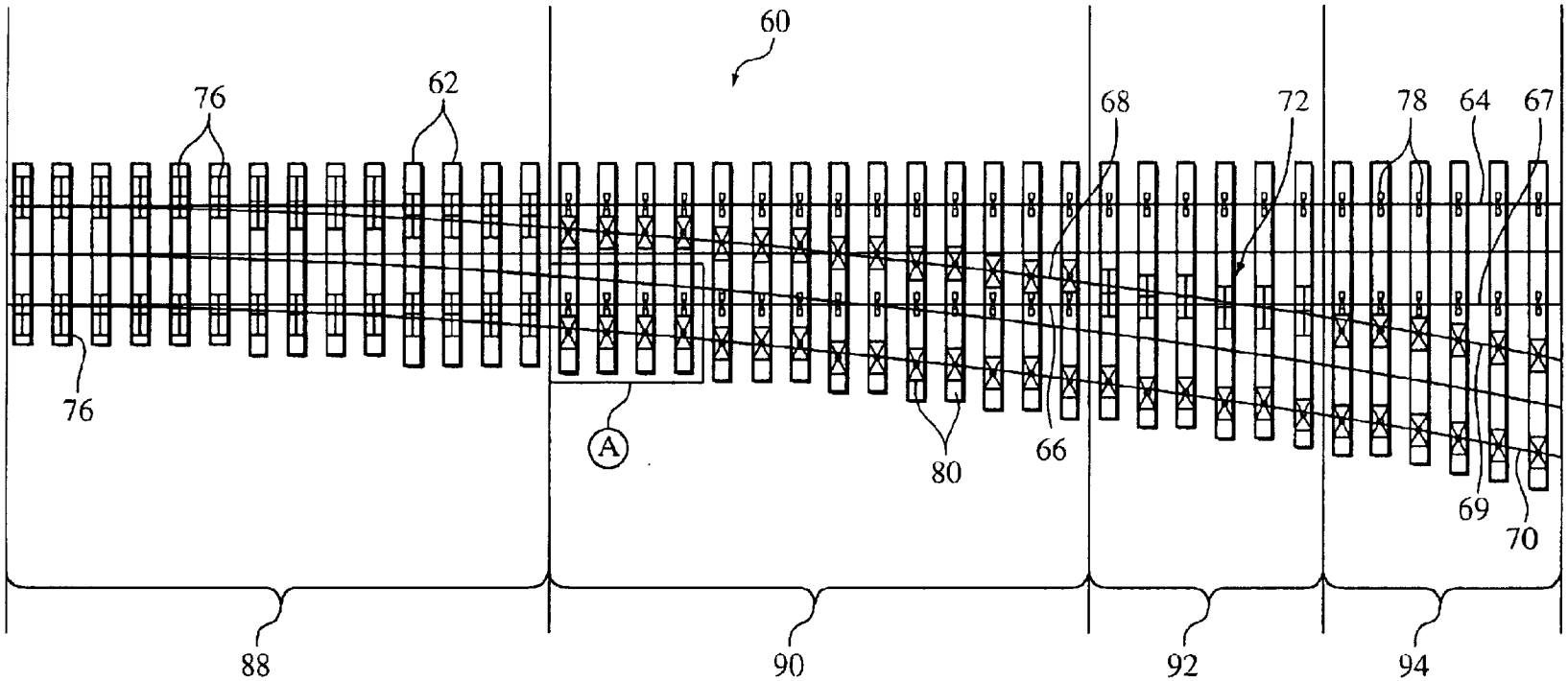
FIG. 9 PRIOR ART
FIG. 9 is plan view of a concrete railroad tie according to the present invention.
Figure 10:
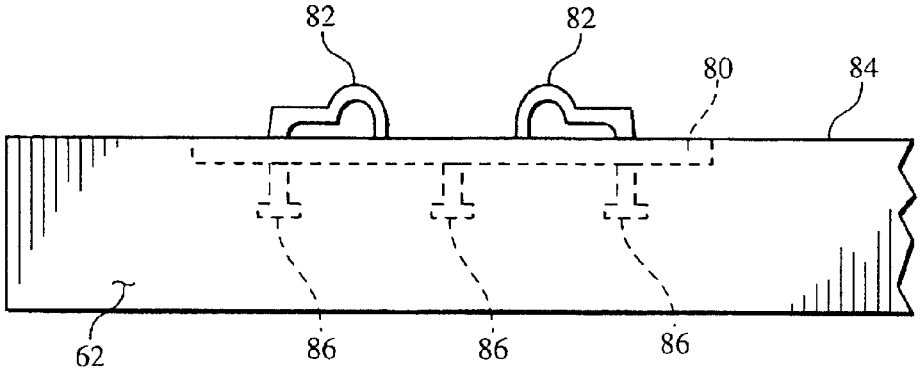
FIG. 10 is a partial side view of a concrete railroad tie having a cast steel bolt receptacle according to the present invention.
Figure 11:
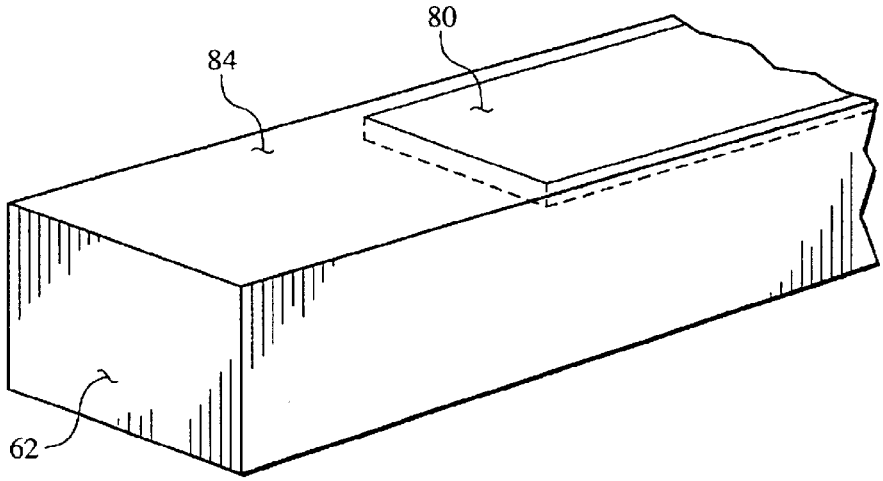
FIG. 11 is a partial perspective view of the concrete railroad tie of FIG. 9 having a steel plate bolted to the present invention.

Reference is made to FIGS. 9–11, which illustrate a concrete railroad tie turnout assembly 60 embodying a preferred embodiment of the present invention. FIG. 9 is a plan view of a turnout assembly 60, which includes a plurality of concrete railroad ties 62 of varying lengths positioned at regular intervals. In the right hand number 7 turnout shown in FIG. 9, a left hand straight stock rail 64 and a right hand straight closure rail 66 extend straight downstream whereas, a left hand curved closure rail 68 and right hand curved stock rail 70 curve to the right when viewed looking downstream. The straight closure rail 66 and curved closure rail 68 intersect at an area known as a frog 72. After the frog 72, the straight closure rail 66 becomes a straight heel rail 67 and the curved closure rail 68 becomes the curved heel rail 69. The frog 72 is located at the intersection of two rails to permit the wheels moving along one of the rails to pass across the other rail. In each turnout assembly 60 of the present invention, the rails are attached to the concrete railroad ties 62 at a rail seat area 71 using a fastening system. According to the present invention, the type of fastening system used is dependent on the position of the concrete railroad tie 62 within the assembly 60. In the preferred embodiment of the present invention, the type of fastening system is selected from a group consisting of a bolted on plate assembly 76 as shown in FIGS. 7 and 8, shoulder assemblies 78 as shown in FIGS. 3 and 4, and cast in steel plates assembly 80 with weld on shoulders 82 as shown in FIGS. 10 and 11 and discussed in more detail below.

Figure 12:
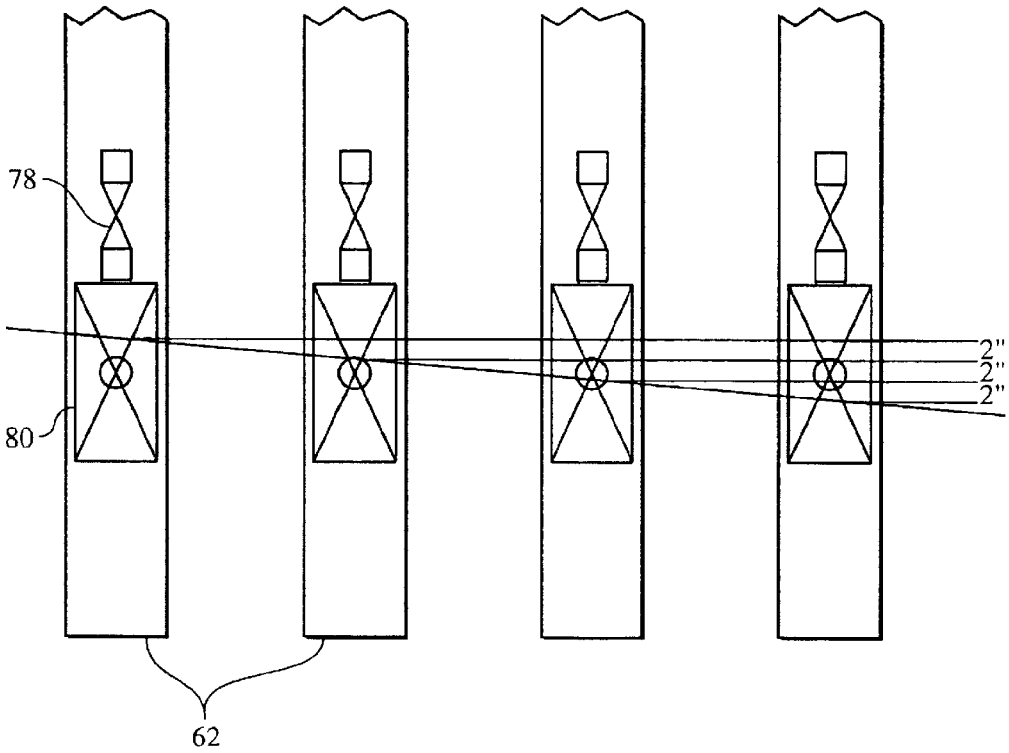
FIG. 12 is a close-up view of area A of FIG. 9.
Figure 13:
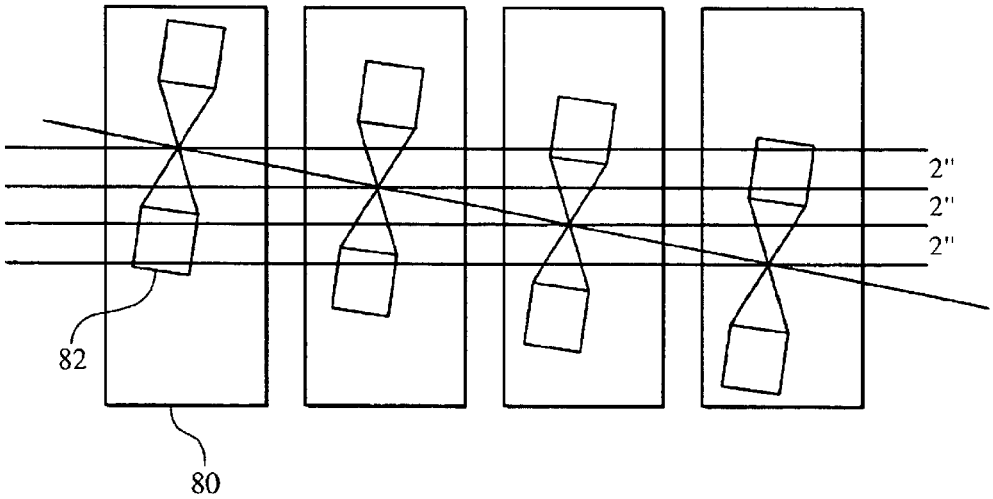
FIG. 13 is a another close-up view illustrating four different weld on shoulder plate positions of the plates of FIG. 12.

The cast in steel plate assemblies 80 according to the present invention (FIGS. 10 and 11) are cast directly into the concrete railroad tie 62 so that the top surface of each cast in steel plate 80 is substantially flush with the top surface 84 of the concrete railroad tie 62. Rail fastening weld on shoulders 82 are then welded to predetermined positions on the steel plate 80. The position on the plate 80 is determined by the displacement of the curved rail and the angle of the rail base with respect to the straight rails (FIGS. 12 and 13.) Each cast in steel plate 80 has at least two and preferably four anchor studs 86, which project downwardly from the underside of the steel plate 80 and are preferably attached by welding. The anchor studs 86 mechanically attach the cast steel plate 80 to the concrete railroad tie 62. In order to cast the steel plates 80 into the concrete railroad tie 62, the plates 80 with anchor studs 86 attached are located in the tie mold prior to filling with concrete.

Of the three types of rail seats in the illustrated turnout, bolted on plates 74 (with associated full sized rubber pads, bolts and insulated cast in threaded inserts) are the most costly. Cast in steel plates 80 (with weld on shoulders and standard crosstie pads and insulators) are the second most costly. The cast in shoulders 78 (with standard pads and insulators) are the least costly. The relative pricing with cast in shoulder rail seat 78 as 1.0, are 1.5 for cast in steel plates 80 and 4.0 for bolted on plates 74.

Some areas of turnouts require special plating that has machined plates, such as the switch, frog and guardrails. These areas use bolted on plates 74. An alternative to bolted on plates 74 is to attach machined plates with additional cast in shoulders that are only used to hold the plates to the tie. This approach is less expensive than with bolts and insulated (for signal integrity) inserts, but requires the cast in shoulders to be insulated where in contact with plates by means of separate insulators or integral insulation. These machined plates with additional cast in shoulders are called clipped plates.

Other rail seats can utilize cast in shoulders 78 and standard pads and insulators where the positions of the shoulders are the same on all numbers and hands of turnouts. These areas include the straight stock rail, straight closure rail and heel rails where not in the switch, frog or guardrail areas.

The remaining rail seat areas are unique to the number and hand of the turnout. These areas are best served by cast in steel plates 80 with weld on shoulders 82. For fully fabricated turnouts the tie manufacturer welds the weld on shoulders 82 into positions dictated by the turnout design. For turnout kits or field tie replacements, the user in the field welds the shoulders to these plates. For the lowest tie manufacturing cost standard, cast in shoulder rail seats 78 are maximized, bolted on plate rail seats 76 are minimized and cast in steel plates 80 are used for the remainder.

Turning again to the illustrated example, the turnout assembly comprises a switch section 88, a closure section 90, a frog section 92 and a heel section 94. In the switch section 88, which is the most upstream section of the turnout assembly 60, the rails are attached to the concrete railroad ties 62 utilizing bolted on plates 76 according to FIGS. 7 and 8.

In the closure section 90, which is immediately upstream of the frog section 92 and downstream of the switch section 88, the straight stock rail 64 and closure rail 66 are attached to the concrete railroad ties 62 by cast in shoulders 78 as shown in FIGS. 3 and 4. The curved stock rail 68 and closure rail 70 are attached to the concrete railroad ties 62 using cast in plates 80 with weld on shoulders 82 as shown in FIGS. 10 and 11.

In the frog section 92 where the straight closure rail 66 and the curved closure rail cross 68, the frog assembly plates 72 are either bolted to the ties 62 or held by additional cast in shoulders 78. Generally the ties that support the frog assembly are also the ties that support guardrails. The guardrail assemblies are attached to the ties in the same manners as the frog assemblies. The straight stock rail 64 and curved stock rail 70 utilize either bolted or clipped plates to match the method of attaching the frog assembly.

In the heel section 94, the straight stock rail 64 and straight heel rail 67 are attached using cast in shoulders 78, while the curved heel rail 69 and stock rail 70 are attached using cast in plates with weld on shoulders.

Additionally, for rail seats utilizing cast in plates, each steel plate 80 can be cast into one of several different positions (FIG. 9) of the concrete railroad tie 62 thus, creating more flexibility as to the positions of the rail fasteners on the railroad tie and reducing the length of the steel plate needed by half to three inches. This invention utilizes concrete ties with lengths in six-inch increments and cast in steel plates with weld on shoulders. Each tie must accommodate the weld on shoulder positions for the curved rail lateral displacement of six inches (FIGS. 12 and 13.) In the present invention, smaller plates that may accommodate two or three-inch lateral curved rail displacements and keying the tie patterns to allow locating plates in multiple positions during the tie casting process.

Figure 5:
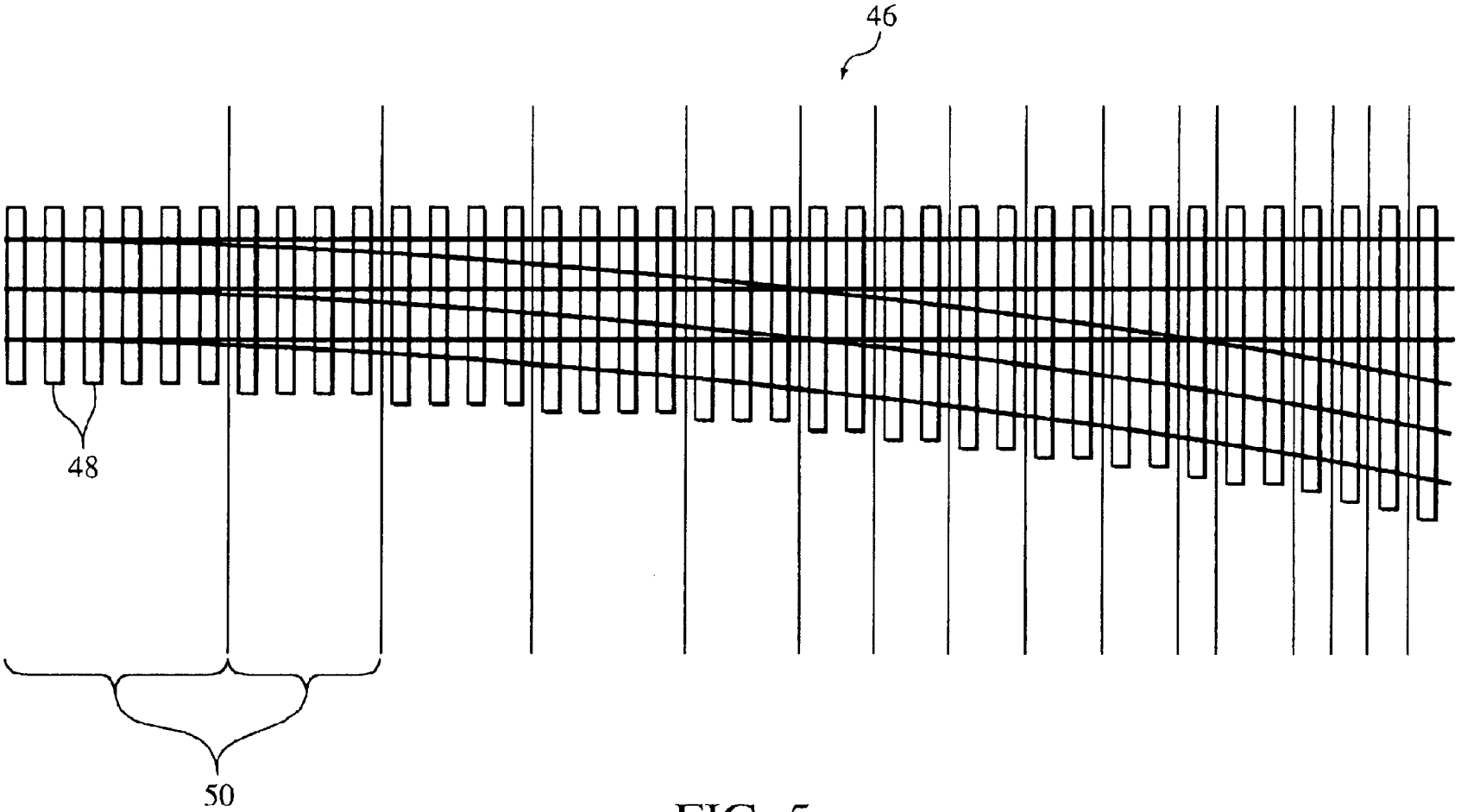
FIG. 5 PRIOR ART
FIG. 5 is plan view of a conventional concrete railroad tie turnout according to the bolted plate prior art.
Figure 6:
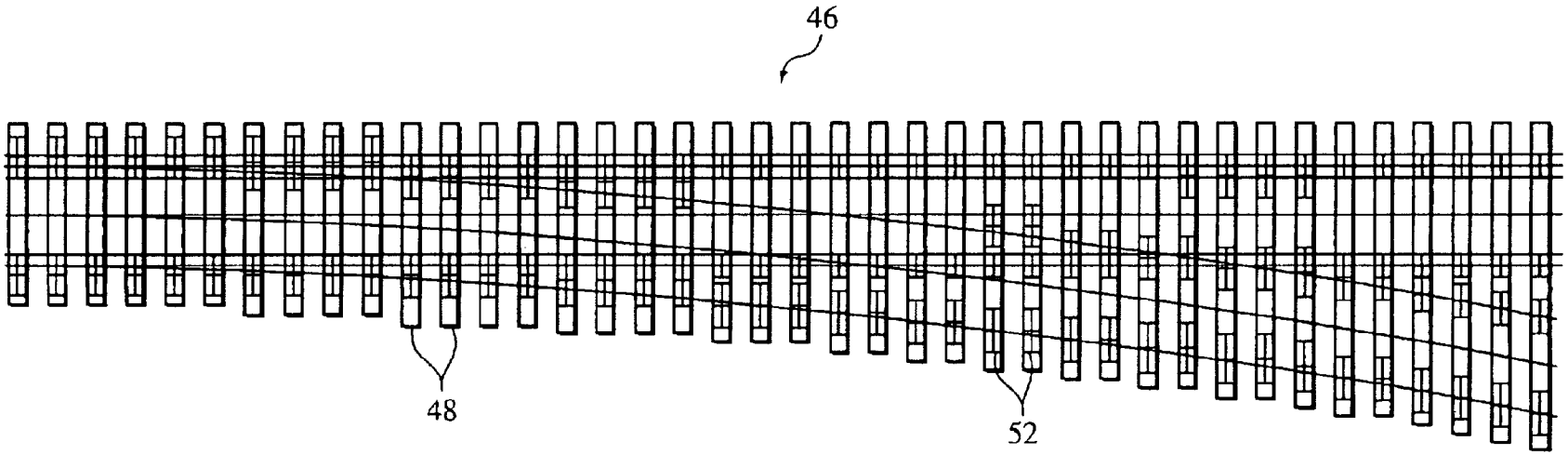
FIG. 6 PRIOR ART
FIG. 6 is plan view of a conventional concrete railroad tie turnout according to the bolted plate turnout prior art.

As discussed previously, one minus associated with conventional concrete railroad turnouts is the increased cost due to the need for separate patterns needed for each railroad tie in the turnout. This is especially costly for transit authorities, which may not necessarily need a lot of turnouts and the type of turnouts that they do need varies. The bolted on plate turnout assembly provides a reduced cost of a single turnout as compared to conventional turnouts. Increased savings are seen for a turnout using the principles of the present invention. Each shoulder and cast plate of the present invention eliminates 4 inserts, 4 bolts and one full sized pad used in a corresponding turnout of the type described in FIG. 5

The cost per conventional concrete turnout decreases as the number of turnouts increases. While the cost per turnout of the bolted plate turnout and the turnout of the present invention stays the same. When producing twenty #7 turnouts the cost per turnout of the present invention is less than the cost per conventional concrete turnout while the cost per bolted plate turnout is almost double that of each conventional turnout.

What is claimed is:

1. A concrete railroad tie turnout assembly having a switch section, a closure section, a frog section and a heel section, the turnout assembly comprising:

a plurality of concrete railroad ties;

a straight stock rail; a curved stock rail; straight closure rail; a curved closure rail, a straight heel rail and a curved heel rail;

a plurality of first rail fastening assemblies for attaching the curved stock rail and the curved closure rail to the concrete railroad ties in the closure section and for attaching the curved heel rail and the curved stock rail to the concrete railroad ties in the heel section, each first rail fastening assembly comprising:

a plate cast into one of the concret railroad ties, the plate having an upper surface substantially flush with the upper surface of the concrete railroad tie; and at least one rail fastener welded to a select one of a plurality of predetermined positions on the upper surface of the plate;

a plurality of second rail fastening assemblies for attaching the straight stock rail and the straight closure rail to the concrete railroad ties in the closure section and for attaching the straight stock rail and the straight heel rail in the heel section, each second fastening assembly comprising a cast in shoulder cast into one of the concrete railroad ties.

2. The concrete railroad tie turnout assembly of claim 1 further comprising:

a plurality of third rail fastening assemblies for fastening rails in the switch section to concrete rail road ties, each rail fastening assembly comprising:

a plate bolted onto the upper surface of one of the concrete railroad ties; and at least one rail fastener attached to an upper surface of the bolted plate, wherein the rail fastener of the third rail assembly is welded to a select one of a plurality of predetermined positions on the upper surface of the bolted plate.

3. The concrete railroad tie turnout assembly of claim 2 further comprising:

a frog assembly plate for attaching the straight closure rail and the curved closure rail to the concrete railroad ties in the frog section.

4. A concrete railroad tie turnout assembly having a switch section, a closure section, a frog section and a heel section, the turnout assembly comprising:

a plurality of concrete railroad ties;

a plurality of first rail fastening assemblies for fastening curved rails to the concrete railroad ties located in the closure section and heel section of the turnout assembly comprising:

a plate cast into one of the concrete railroad ties in the closure section or heel section, the plate having an upper surface substantially flush with the upper surface of the concrete railroad tie in the closure section or heel section; and at least one rail fastener, for fastening the rail to the closure section or heel section concrete railroad tie, welded to a select one of a plurality of predetermined positions on the upper surface of the plate, said select one position based on the intended position of the closure section or heel section concrete railroad tie in the railroad tie turnout assembly; and a plurality of second rail fastening assemblies for fastening rails to the concrete railroad ties located in a switch section of the turnout assembly, each second rail fastening assembly comprising:

a plate bolted onto the upper surface of one of the concrete railroad ties in the switch section; and a rail fastener attached to an upper surface of the bolted plate for fastening said one of the rails to the railroad tie in the switch section, wherein the rail fastener of the second rail assembly is welded to a select one of a plurality of predetermined positions on the upper surface of the bolted plate based on the intended position of the switch section concrete railroad tie in the railroad tie turnout assembly.

5. A concrete railroad tie turnout assembly having a switch section, a closure section, a frog section and a peel section, the turnout assembly comprising:

a plurality of concrete railroad ties having different lengths, wherein the concrete railroad ties are positioned in parallel to each other at predetermined intervals in groups, such that the length of each group changes successively;

a first rail fastening assembly for fastening a first rail to a first one of the concrete railroad ties located in a section of the turnout assembly selected from the group consisting of the closure section, the frog section and the heel section, the first rail fastening assembly comprising:

a plate cast into the first concrete railroad tie having an upper surface substantially flush with the upper surface of the first concrete railroad tie; and at least one rail fastener, for fastening the first rail to the first concrete railroad tie, welded to a select one of a plurality of predetermined positions on the upper surface of the plate, said select one position based on the intended position of the first concrete railroad tie in the railroad tie turnout assembly;

a second rail fastening assembly for fastening a second rail to the first concrete railroad tie comprising a cast in shoulder cast into the first concrete railroad tie for securing a second rail to the first concrete railroad tie; and a third rail fastening assembly for fastening one of the rails to a second one of the concrete railroad ties located in the switch section of the turnout assembly comprising:

a plate bolted onto the upper surface of the second concrete railroad tie; and a rail fastener attached to an upper surface of the bolted plate for fastening said one of the first and second rails to the second concrete railroad tie, wherein the rail fastener of the third rail assembly is welded to a select one of a plurality of predetermined positions on the upper surface of the bolted plate based on the intended position of the second concrete railroad tie in the railroad tie turnout assembly.

6. A concrete railroad tie turnout assembly having a switch section, a closure section, a frog section and a heel section, the turnout assembly comprising:

a plurality of concrete railroad ties having different lengths, wherein the concrete railroad ties are positioned in parallel to each other at predetermined intervals in groups, such that the length of each group changes successively;

a first rail fastening assembly for fastening a first rail to a first one of the concrete railroad ties located in the frog section of the turnout assembly comprising:

a plate cast into the first concrete railroad tie having an upper surface substantially flush with the upper surface of the first concrete railroad tie; and at least one rail fastener, for fastening the rail to the first concrete railroad tie, welded to a select one of a plurality of predetermined positions on the upper surface of the plate, said select one position based on the intended position of the first concrete railroad tie in the railroad tie turnout assembly;

a second rail fastening assembly comprising a frog assembly plate bolted on to the first concrete railroad tie, the frog plate assembly for attaching a second rail and a third rail to the first concrete railroad;

a third rail fastening assembly for fastening a fourth rail to the first concrete railroad tie comprising a cast in shoulder cast into the first concrete railroad tie for securing a fourth rail to the first concrete railroad tie; and a fourth rail fastening assembly for fastening one of the rails to a second one of the concrete railroad ties located in the switch section of the turnout assembly comprising:

a plate bolted onto the upper surface of the second concrete railroad tie; and a rail fastener attached to an upper surface of the bolted plate for fastening said one of the first, second, third and fourth rails to the second concrete railroad tie, wherein the rail fastener of the fourth rail assembly is welded to a select one of a plurality of predetermined position on the upper surface of the bolted plate based on the intended position of the second concrete railroad tie in the railroad tie turnout assembly.

* * * * *